US008336146B1

(12) United States Patent
Berbash

(10) Patent No.: US 8,336,146 B1
(45) Date of Patent: Dec. 25, 2012

(54) FORCED AIR HEATED MAT

(76) Inventor: Khaled M. Berbash, Waterloo (CA)

( * ) Notice: Subject to any disclaimer, the term of this patent is extended or adjusted under 35 U.S.C. 154(b) by 29 days.

(21) Appl. No.: 13/159,149

(22) Filed: Jun. 13, 2011

(51) Int. Cl.
*E01D 1/00* (2006.01)

(52) U.S. Cl. ..... 14/69.5; 404/34; 404/35; 404/79

(58) Field of Classification Search ..... 14/69.5–71.5; 404/34–36, 77, 79; 193/38, 41
See application file for complete search history.

(56) References Cited

U.S. PATENT DOCUMENTS

| | | | | |
|---|---|---|---|---|
| 4,646,818 | A | 3/1987 | Ervin, Jr. | |
| 5,591,365 | A | 1/1997 | Shields | |
| D406,000 | S * | 2/1999 | Hartranft | D6/583 |
| 6,051,811 | A | 4/2000 | Hardison | |
| 6,180,929 | B1 | 1/2001 | Pearce | |

* cited by examiner

*Primary Examiner* — Raymond W Addie

(57) ABSTRACT

A forced air heated mat including a parallelepiped central pad connected to a ramp, a first side ramp, and a second side ramp, through which pad heated air is directed via a latticework of air channels to a plurality of vent holes to melt accumulated snow and ice around a home or building. The present forced air heated mat is configured to interconnect with a heating exhaust or drier vent on the exterior of a home or building to direct waste heat to perform useful work in melting accumulated snow and ice.

7 Claims, 5 Drawing Sheets

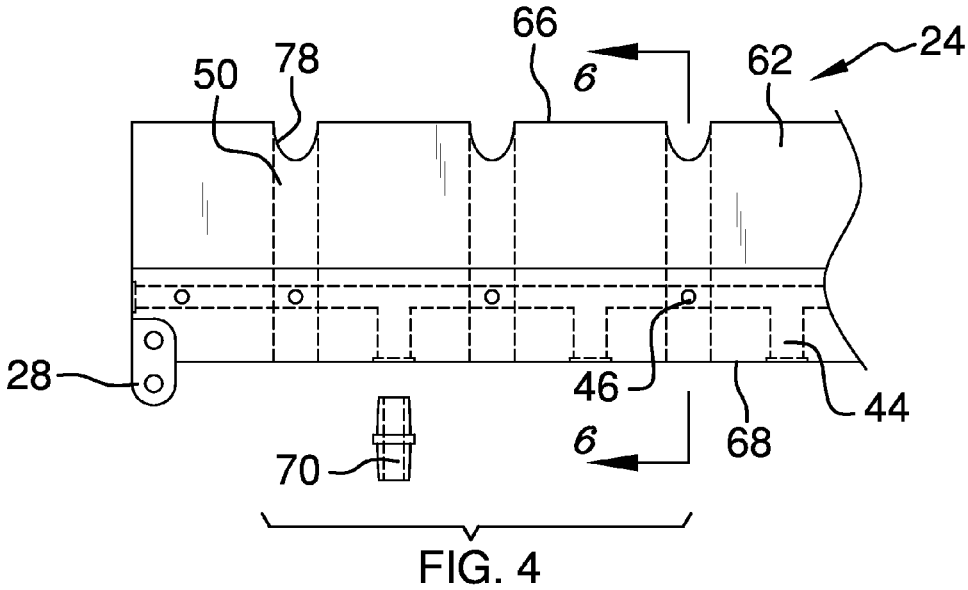
FIG. 4
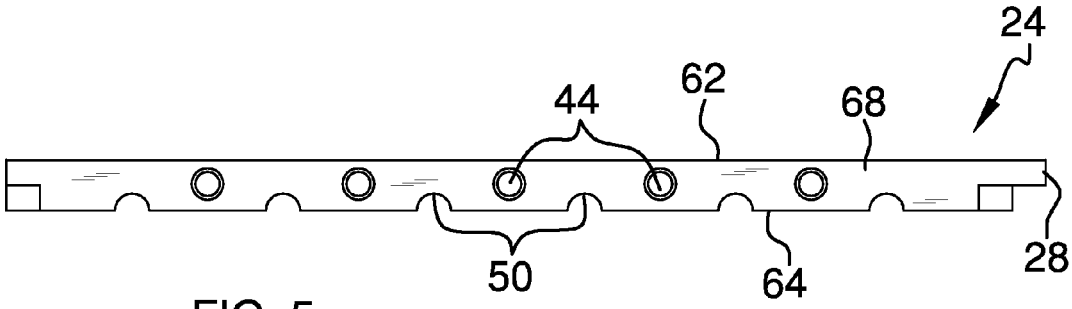
FIG. 5
FIG. 6
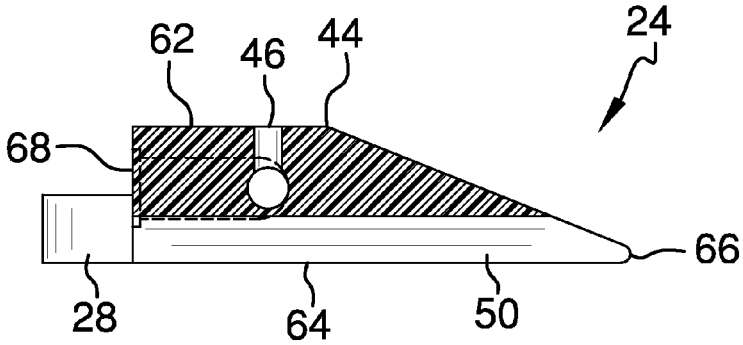

FORCED AIR HEATED MAT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of heated mats are known in the prior art. However, what is needed is a forced air heated mat including a latticework of air channels that direct airflow from a forced air heating source, such as a home heating exhaust or drier vent, to the melting of snow and ice in the driveway or elsewhere about the home and other buildings.

FIELD OF THE INVENTION

The present invention relates to heated mats, and more particularly, to a forced air heated mat which interconnects to a forced air heating source, also referred to as "FANS", such as a home heating exhaust or drier vent to direct heated air through a latticework of air channels to melt snow and ice about the home and other buildings as desired.

SUMMARY OF THE INVENTION

The general purpose of the present forced air heated mat, described subsequently in greater detail, is to provide a forced air heated mat which has many novel features that result in a forced air heated mat which is not anticipated, rendered obvious, suggested, or even implied by prior art, either alone or in combination thereof.

The present forced air heated mat has been devised to assist in the clearing of snow and ice from around the home, office, or other building subject to the build up of snow and ice. The present device saves time and physical labor by clearing snow and ice from ground surfaces without the need for shoveling or clearing the snow and ice manually or mechanically.

The present device has been configured to direct heated air to melt snow and ice upon the ground, on the driveway, or elsewhere about the home or building where the device may be used. Other heated mats are seen in the prior art, however the present forced air heated mat differs from the heating mats evinced in the prior art in that the present device uses heated air to melt snow, which heated air is generated from a home or building heat exhaust, drier vent, or other applicable sources. The present device is a new and useful improvement over inventions evinced in the prior art devised to meet similar aims in that the present device recycles waste heat and applies it to perform useful work.

Other heating mats of the prior art are electrically powered, and circulate air or a liquid through their interiors, thus radiating heat specifically generated for the heating mat, heat produced additional to the heat within the home or building. In an era of environmental concern and increasing energy costs, the present forced air heating mat has been devised to operate at no extra cost, the present forced air heated mat utilizing waste heat to direct said heat to perform useful work about the exterior of the home or building where the forced air heated mat is used.

Thus has been broadly outlined the more important features of the present forced air heated mat so that the detailed description thereof that follows may be better understood and in order that the present contribution to the art may be better appreciated.

BRIEF DESCRIPTION OF THE DRAWINGS

Figures

FIG. 4 is a top view of a side ramp.

FIG. 5 is a back view of a side ramp.

FIG. 6 is a cross section of a side ramp taken along the line 6-6 of FIG. 4

DETAILED DESCRIPTION OF THE DRAWINGS

Figure 1:
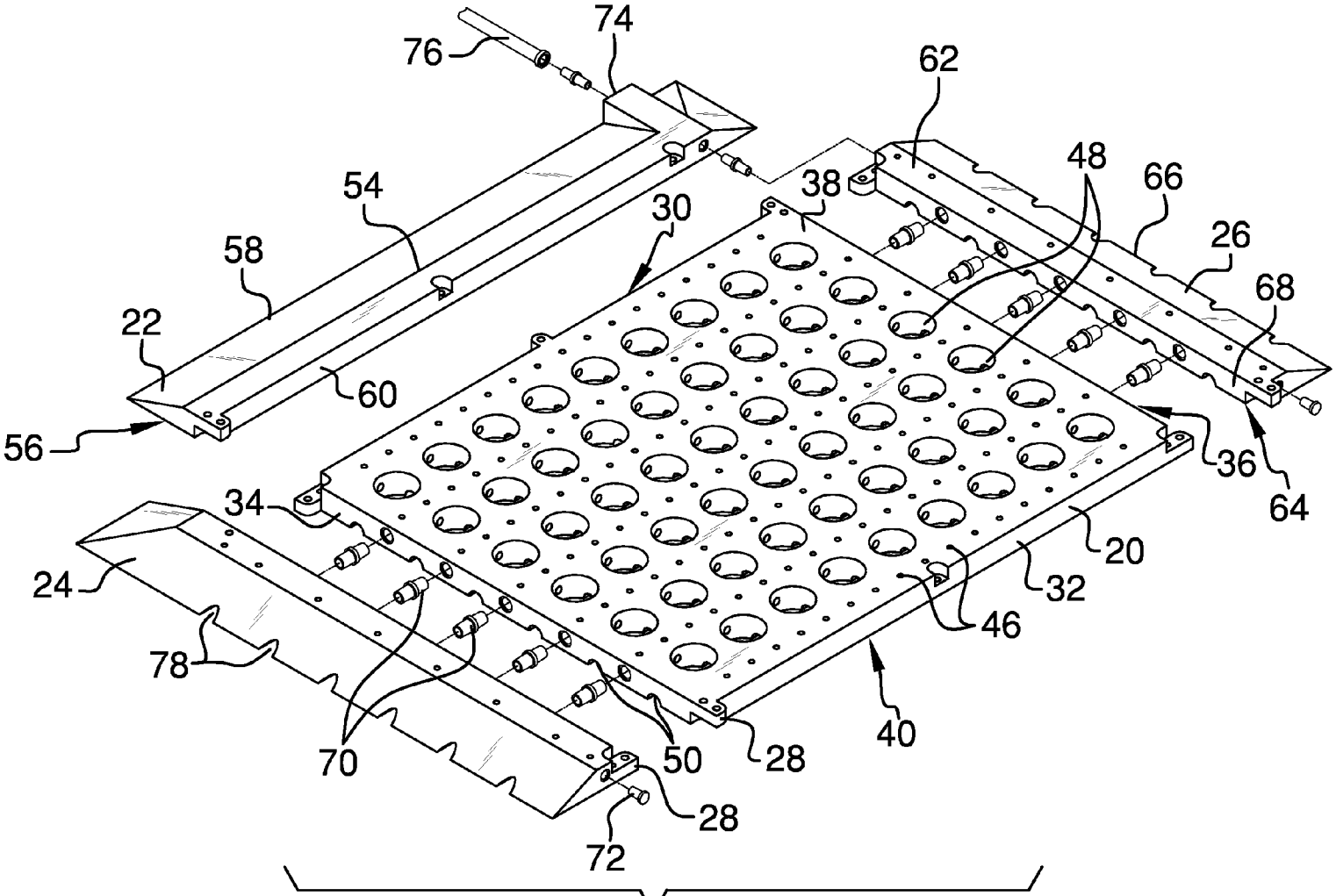
FIG. 1 is an exploded isometric view.
Figure 2:
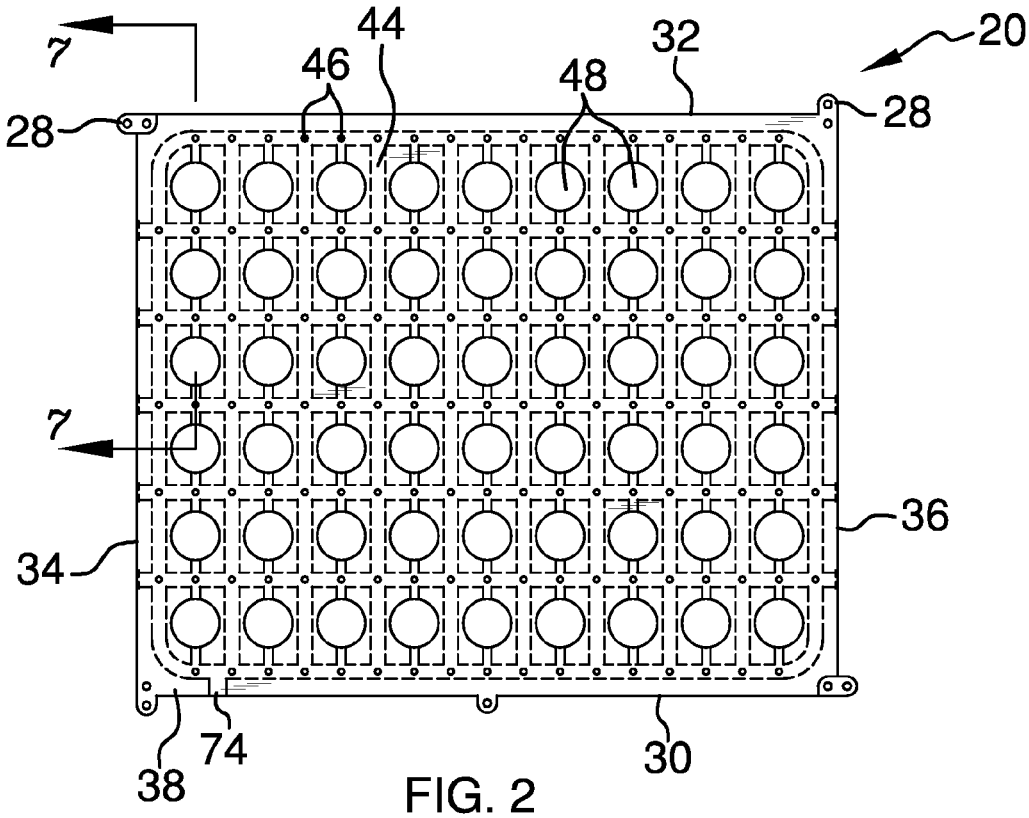
FIG. 2 is a top view.
Figure 3:
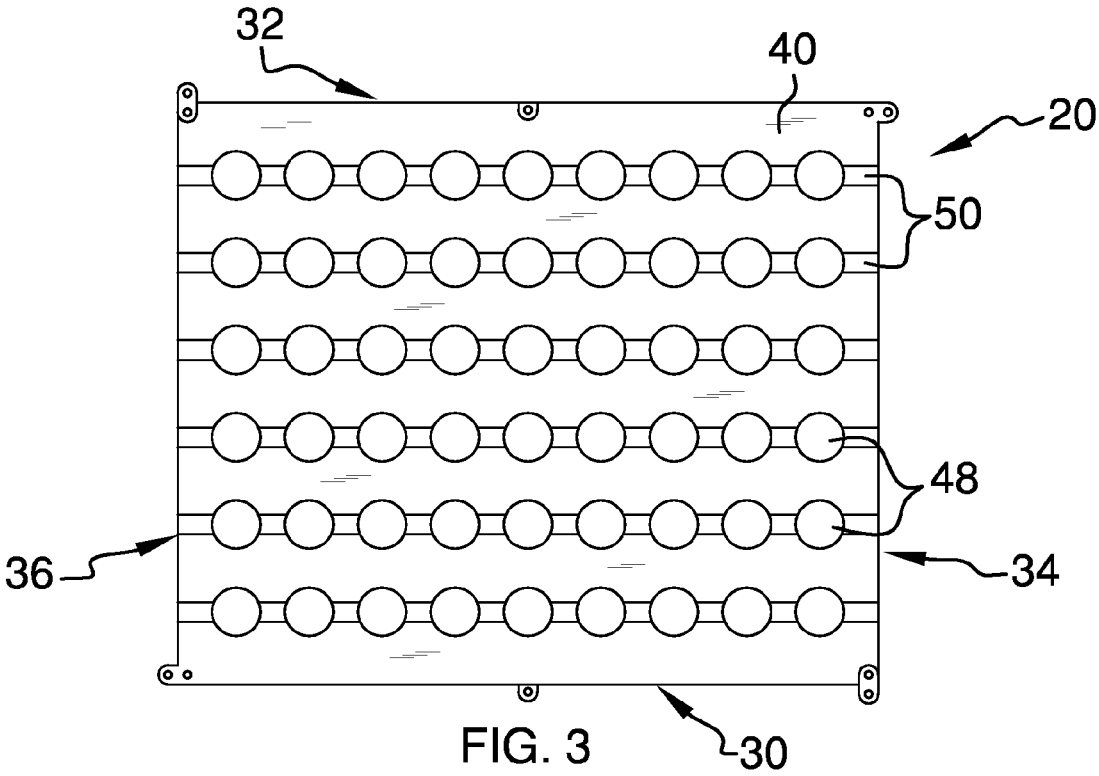
FIG. 3 is a bottom view.
Figure 7:
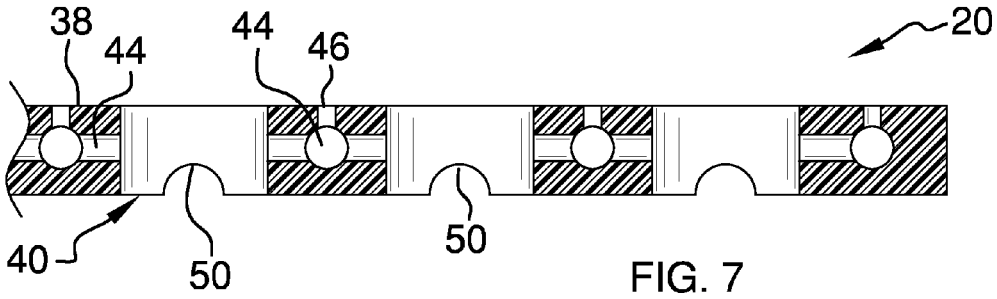
FIG. 7 is a cross section of a heated pad taken along the lines 7-7 of FIG. 2
Figure 8:
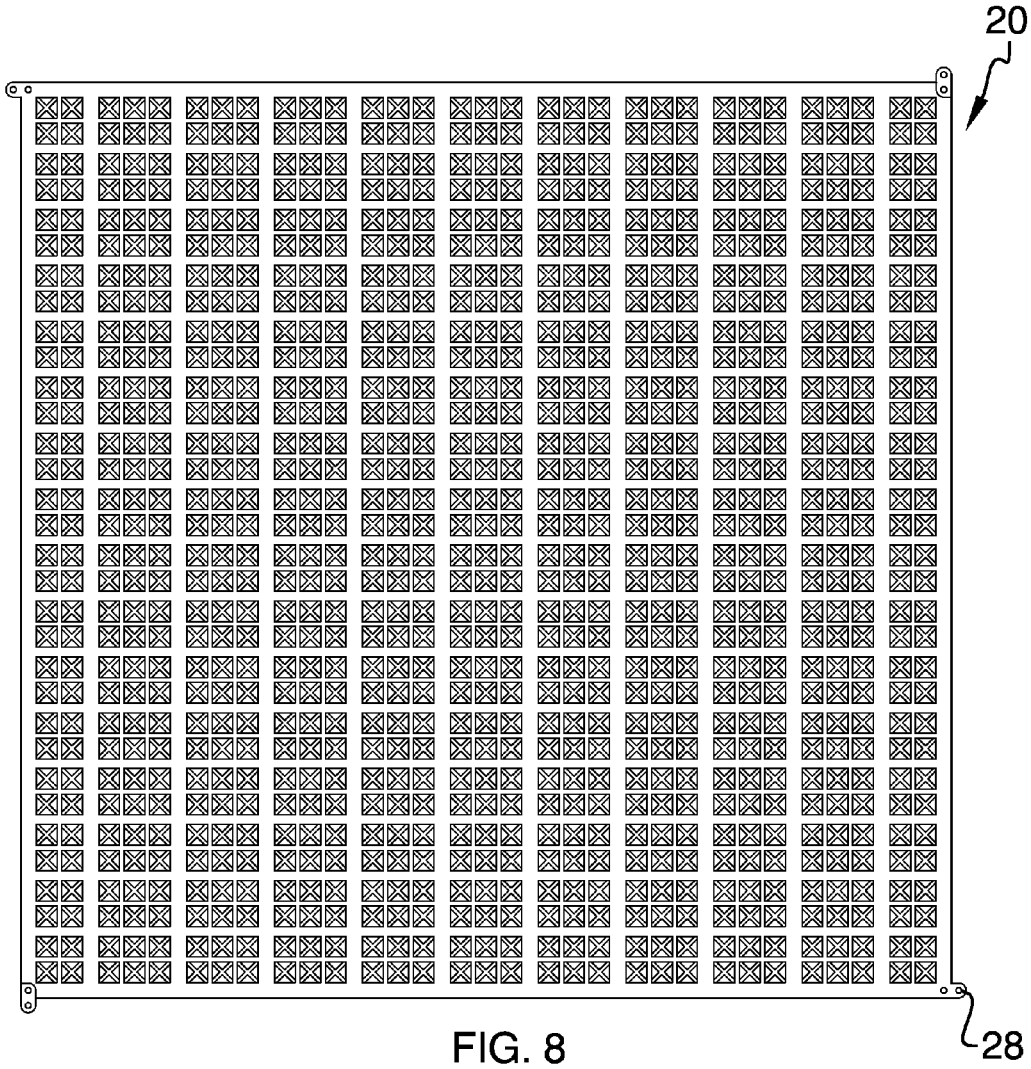
FIG. 8 illustrates an alternate embodiment.
Figure 9:
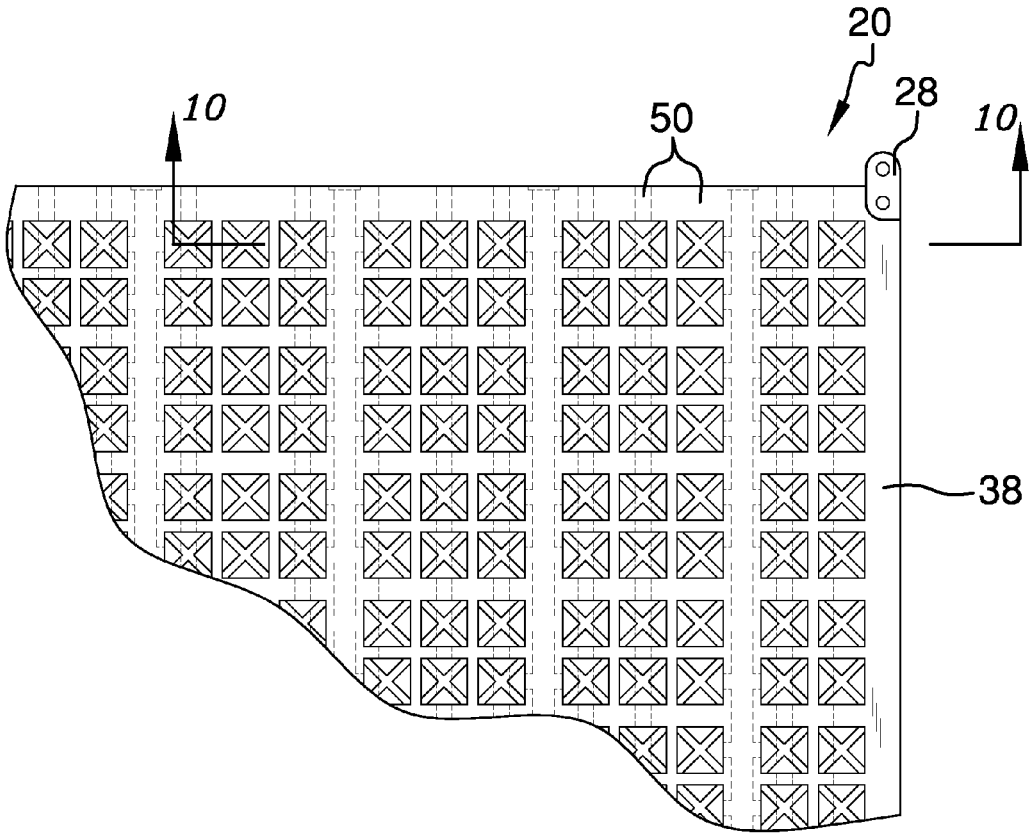
FIG. 9 illustrates a detail view of FIG. 8.
Figure 10:
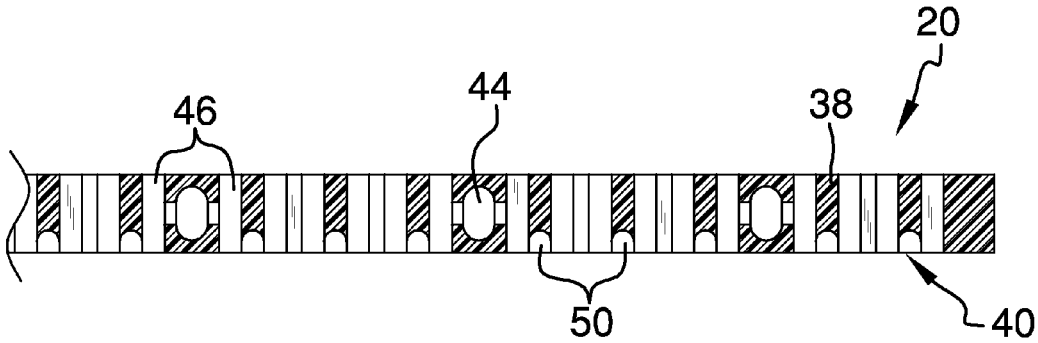
FIG. 10 is a cross section along the line 10-10 of FIG. 9.

With reference now to the drawings, and in particular FIGS. 1 through 10 thereof, example of the instant forced air heated mat employing the principles and concepts of the present forced air heated mat and generally designated by the reference number 10 will be described.

Referring to FIGS. 1 through 10 a preferred embodiment of the present forced air heated mat 10 is illustrated. The present forced air heated mat 10 includes four main components which interconnect as a kit used to direct waste heat generated in the home or building to the melting of accumulated snow and ice. The present forced air heated mat 10 consists of a parallelepiped central pad 20, a ramp 22, a first side ramp 24 and a second side ramp 26, interconnected by a plurality of attachment members 28. These attachment members 28 overlap and interlock to mesh the pad 20, the ramp 22, and the first 24 and second 26 side ramps together. As is apparent by a close inspection of the accompanying drawings, these attachment members 28 are configured to enable the attachment of multiple pads 20 together, as desired, so that the forced air heated mat 10 may be configured to cover specific areas, as desired.

Having briefly discussed the main components of the present forced air heated mat 10, I will now proceed to discuss each of the aforementioned components in more detail so to enable a deeper and clearer understanding of the present device 10, its uses and intents.

The parallelepiped central pad 20 includes a front side 30, a rear side 32, a first side 34, a second side 36, a top side 38 and an underside 40 bounding an interior 42. A latticework of air channels 44 is disposed throughout the pad 20 interior 42, through which air channels 44 heated air is forced from a heat source (not shown) to a plurality of vent holes 46. These vent holes 46 are configured in rows along the length of each air channel 44 across the pad 20 top side 38. Vent holes 46 are also disposed within a series of perforations 48.

This series of perforations 48 is disposed across the pad 20 top side 38, said perforations 48 interconnecting with a plurality of water channels 50 disposed throughout the pad 20 underside 40. The plurality of water channels 50 consists of semi-cylindrical grooves disposed along the pad 20 underside 40 in parallel rows, said water channels 50 oriented transversely between the pad 20 first side 34 and the pad 20 second side 36.

A substantially wedge-shaped ramp 22 releasably attaches to the pad 20 front side 30, the ramp 22 including a dorsal side 54 and a basal side 56, a front edge 58, and a rear edge 60, the rear edge 60 releasably attaching to the pad 20 front side 30 by means of the attachment members 28.

The first side ramp 24 and the second side ramp 26 releasably attach to the pad 20 first side 34 and the pad 20 second side 36 respectively, said first 24 and second 26 side ramps substantially wedge-shaped with an upper side 62 and a lower side 64, a fore edge 66 and a back edge 68, which back edge 68 releasably attaches to each of the pad 20 first 32 and second 34 sides by means of the attachment members 28.

The attachment members 28 are interlocking protrusions configured to overlap and mesh together the pad 20, the ramp 22, the first side ramp 24 and the second side ramp 26. The attachment members 28 are further configured to interconnect two or more pads 20 as desired. The first side 34 and the second side 36 of two or more pads 10 are thereby connectable. The front side 30 and the rear side 32 of two or more pads are thereby connectable.

A primary inlet 74 is disposed on the ramp 22, said inlet 74 in operational communication with a heat source (not shown) of heated air via a hose 76. This heat source (not shown) is considered to be a heating exhaust or drier vent located on the exterior of a home or building. The forced air heated mat 10 does not internally provide a source of heat or airflow.

A plurality of nozzles 70 interconnect the air channels 44 of the pad 20 interior 42 to the primary inlet 66, the first side ramp 24, and the second side ramp 26.

A pair of plugs 72 my be removed from the first 24 and second 26 side ramps when two or more forced air heated mat 10 pads 20 are interconnected, allowing the continuous connection of air channels 44 between pads 20 of the forced air heated mat 10.

Heated air is thereby directed within the forced air heated mat 10 through the air channels 44 to melt accumulated snow and ice. Subsequent melt water (not shown) is borne through the series of perforations 48, along the plurality of water channels 50, and drained through a plurality of notches 78 disposed along each of the first 24 and second 26 side ramp fore edges 58, said melt water thereby directed away from the pad 20.

The present device 10 therefore provides new and useful improvements to the art, enabling the redirection of waste heat toward useful work about the home or building where the forced air heated mat is used to melt snow and ice and clear a road or walking surface for easy passage therethrough.

What is claimed is:

1. A forced air heated mat comprising:

a parallelepiped central pad, the pad comprising:

a front side, a rear side, a first side, a second side, a top side and an underside bounding an interior;

a latticework of air channels disposed throughout the pad interior, through which air channels heated air is forced to a plurality of vent holes;

a series of perforations disposed across the pad top side, said perforations interconnected with a plurality of water channels disposed throughout the pad underside;

a substantially wedge-shaped ramp releasably attached to the pad front side, the ramp comprising a dorsal side and a basal side, a front edge, and a rear edge, the rear edge releasably attached to the pad front side;

a plurality of interlocking attachment members disposed between the ramp rear edge and the pad front side, wherein the attachment members releasably attach the ramp rear edge to the pad front side;

a first side ramp and a second side ramp releasably attached to the pad first side and the pad second side respectively, said first and second side ramps substantially wedge-shaped with an upper side and a lower side, a fore edge and a back edge, wherein the back edge releasably attaches to the pad;

a primary inlet disposed on the ramp, the inlet in operational communication with a heat source wherein a hose operationally communicates with the inlet and the heat source body;

a plurality of nozzles, wherein then nozzles interconnect the air channels of the pad interior to the inlet, the first side ramp and the second side ramp;

wherein heated air is forced into the latticework of air channels throughout the pad interior and expelled through a plurality of vent holes.

2. The forced air heated mat of claim 1 wherein the attachment members comprise interlocking protrusions configured to overlap and mesh together the pad, the ramp, the first side ramp and the second side ramp.

3. The forced air heated mat of claim 2 further comprising a plurality of second pads, wherein the second pads interconnect the pad whereby the surface area covered by the forced air heated mat is increased.

4. The forced air heated mat of claim 3 wherein the vent holes are configured in rows along the length of each air channel.

5. The forced air heated mat of claim 4 wherein the vent holes are disposed within each perforation.

6. The forced air heated mat of claim 5 wherein the water channels comprise semi-cylindrical grooves disposed along the pad underside in parallel rows, the grooves oriented transversely from the pad first side to the pad second side.

7. The forced air heated mat of claim 6 wherein the first side ramp and the second side ramp have a plurality of notches disposed along each first and second side ramp fore edge, wherein each notch encircles the terminus of a water channel.

* * * * *